United States Patent [19]

Jarder et al.

[11] 4,233,523

[45] Nov. 11, 1980

[54] PRESSURE SENSITIVE DEVICE

[76] Inventors: Lars Jarder, 41 Lomvaegen, Sollentuna, Sweden S-191 56; Bengt Ahlstroem, 2A Malmvaegen, Sollentuna, Sweden S-191 61

[21] Appl. No.: 5,468

[22] Filed: Jan. 22, 1979

[30] Foreign Application Priority Data

Jan. 31, 1978 [SE] Sweden ..... 7801148

[51] Int. Cl.[2] ..... H01H 36/00

[52] U.S. Cl. ..... 307/119; 200/86 R; 336/20; 428/68; 428/465; 428/492

[58] Field of Search ..... 428/68, 492, 465, 913; 200/86 R; 340/38 L, 365 L; 336/20; 307/119

[56] References Cited

U.S. PATENT DOCUMENTS

| | | | |
|---|---|---|---|
| 3,772,684 | 11/1973 | Scantlin | 340/365 L |
| 3,818,369 | 6/1974 | Brocker | 340/365 L X |
| 3,830,991 | 8/1974 | Durocher | 200/86 R |
| 3,984,764 | 10/1976 | Koerner | 340/38 L X |
| 4,085,394 | 4/1978 | Weisenburger | 336/20 |
| 4,090,045 | 5/1978 | Marsh | 200/86 R X |

*Primary Examiner*—George F. Lesmes
*Assistant Examiner*—R. Eugene Varndell, Jr.
*Attorney, Agent, or Firm*—Holman & Stern

[57] ABSTRACT

A pressure-sensitive device is proposed which includes an electrically conducting element in the form of a loop, a screen arranged outwardly of the loop, and a resiliently compressible, non-conducting material between the screen and element, the arrangement being such that, on the application of a loading to the screen, the electrical inductance of the loop is changed, such change being sensed by a reactance-dependent detecting circuit (DET) connected therewith.

5 Claims, 6 Drawing Figures

PRESSURE SENSITIVE DEVICE

This invention concerns a pressure-sensitive device and has more particular reference to a device which includes an electrically conducting wire loop connected with a reactance-dependent detecting circuit.

It is known that by changing the relative positions of two inductance-coils it is possible to change their electromagnetic interaction and thereby their mutual inductance. It is also known that by changing the geometrical shape of a coil it is possible to change its self inductance.

The object of the present invention is to provide a simple and reliable pressure-sensitive device based on the foregoing principles.

According to the invention there is proposed a pressure sensitive device comprising at least one electrically conducting loop connected to a reactance-dependent detecting circuit, preferably an oscillator circuit, a body of a flexible, non-conductive material within which the conducting loop is embedded, and a screen of an electrically conducting material at one side, at least, of the said body, adapted, upon the application thereto of mechanical forces, to cause a change of inductance of the loop.

The electromagnetic character of the device provides that by a change of the magnetic flux a current will develop in the screen in an indefinite number of imagined current paths, which will resist the change of flux, whereby a mutual inductance between the coil and the screen will develop and cause a reduction of the total inductance, seen from the oscillator.

By mechanical loading of the device, the distance between the screen and the conducting loop can be reduced, which develop an increased mutual inductance that furthermore reduces the inductance, seen from the oscillator.

The screen, which for the wire loop works as an inductance-affecting coil, is preferably made so that it will surround the magnetic field of the wire loop, whereby at the same time a screening against interference from external magnetic fields will be obtained.

By using several wire loops having mutually inclined respective geometrical planes, on application of external mechanical loads to the device, in addition to the change in electromagnetic connection between the wire loops and the screen, also a similar change of inductance between the wire loops will be obtained.

If the wire loop is placed near the screen it will, on mechanical loading of the device, undergo a geometrical change, whereby its self inductance will change.

By combining the above mentioned features an optimal device can be achieved as regards shape, sensitivity and directivity. Moreover, with the help of an appropriately chosen flexible non-conducting material, the device can be made to regain its original shape on removal of the mechanical loading. The sensitivity of the device is determined not only by the nature but also by the quantity of flexible non-conducting material used.

The device of the invention is inert to environmental conditions; its function will not be affected by different weather conditions and it can be made resistant to corrosion. Furthermore, the device is readily applicable to existing constructions.

The invention will now be described further by way of example only, with reference to the accompanying diagrammatic drawings which illustrate several embodiments thereof and in which.

Figure 1:
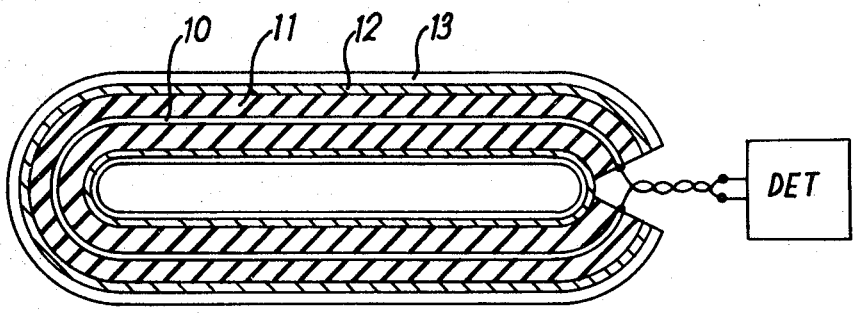
FIG. 1 shows an embodiment having a single wire element therein.

Referring now to the drawings, and particularly to FIG. 1 thereof, a pressure-sensitive device constructed in accordance with the invention has a single conducting wire 10 embedded in an annular body 11 of a non-conducting, flexible material mainly rubber doughy. The flexible material body 11 is totally surrounded by a flexible conducting screen 12, which is itself surrounded by a protective cover 13, for instance of plastic or rubber material, the arrangement being such as to provide a device of ring-shaped form. The ends of the conducting wire 10 are connected to a reactance-dependent detecting circuit (DET), whereby a change of inductance in the conducting loop 10 can be detected. The inductance of the loop will change on application of external mechanical forces to the device due partly to a change in the electromagnetic connection between the conducting loop 10 and the screen 12 and partly to a change in the geometrical shape of such loop 10.

Figure 2:
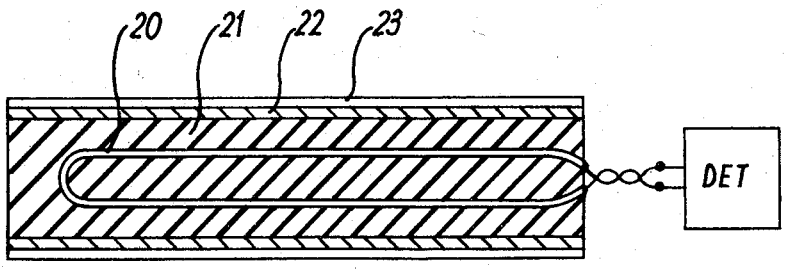
FIG. 2 shows an embodiment having a double-wire element therein.

An alternative embodiment is shown in FIG. 2 and comprises a double-wire in the form of a loop 20 arranged in a body 21 of a non-conducting flexible material 21, there being a flexible conducting screen 22 and an outer protective cover 23 arranged outwardly of the body.

This device operates in like manner to that shown in FIG. 1, the ends of the screen 22 being separated from each other, thereby to allow of the production of a thinner device.

Figure 3:
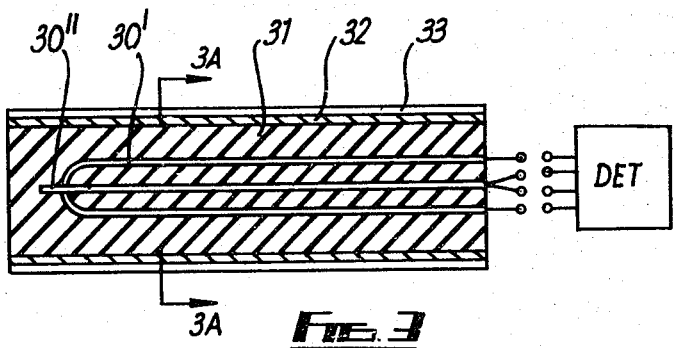
FIG. 3 illustrates a modification of the arrangement shown in FIG. 2 wherein two angularly-spaced double-wire elements are provided.
Figure 3A:
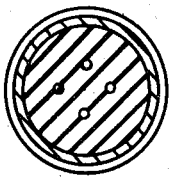
FIG. 3A is a section on line X—X of FIG. 3.

A modification of the device of FIG. 2 is illustrated in FIG. 3 and the modified structure will be seen to comprise two conducting loops 30' and 30'', having respective planes turned through approximately 90 degrees in relation to each other and disposed within a body 31 of a non-conducting, flexible material itself surrounded by a flexible conducting screen 32 having a protective cover 33 thereabout. In addition to the change in electromagnetic connection between the conducting loops and the screen, arising from the application of mechanical forces to the device, the mutual inductance between the conducting loops will also change. The loops 30' and 30'' may be connected either in series or in parallel circuit with the reactance-dependent detecting-circuit (DET).

The embodiments described in relation to FIGS. 1 to 3 are particularly suitable as protection against jamming in doors, machine tools, since they are sensitive to loads applied in any direction. They may, however, also be used as, for example, alarm-transmitters, touch-transmitters, bending-indicators or twisting-indicators.

Figure 4A:
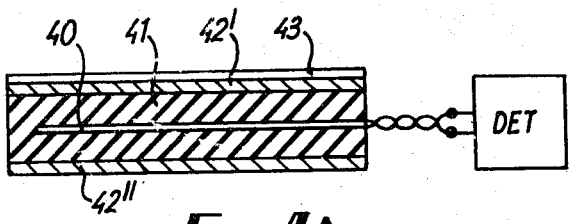
FIGS. 4A and 4B show a longitudinal section and a plan view, respectively, of a pressure sensitive mat constructed in accordance with the invention.
Figure 4B:
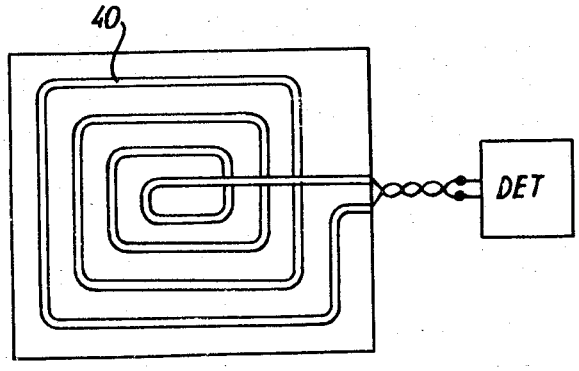

A pressure-sensitive mat constructed in accordance with the invention is shown in FIGS. 4A and 4B. Such a mat can for instance be used not only as an impulse-transmitter for the automatic opening of doors or the starting of escalators, but also as an alarm-transmitter or the like. The embodiment shown in FIGS. 4A and 4B has a conducting loop 40 arranged in a single plane with an optional number of windings and with optional design. A respective metal plate 42', 42'' is provided at each side of the conducting loop, each plate being separated from the loop by means of a layer 41 of nonconducting flexible material. The upper metal plate 42' is preferably flexible in order to increase the sensitivity of the device to point-stress and is equipped with a flexible wear and protection cover 43. The operation of the device shown in FIGS. 4A and 4B is analogous to that of the device shown in FIG. 1.

If the detecting circuit includes an oscillator, then a change of inductance of any of the devices herein described will give rise to a change in frequency of such oscillator. A convenient way of detecting small change of frequency is to count the number of pulses emitted by the oscillator during two successive timeintervals of the same length and compare the number of pulses or alternatively let the emitted pulses decide the time-interval during which an oscillator with a fixed frequency will trigger a counter. Different counted numbers of pulses and time-intervals of different lengths respectively will thereby indicate mechanical operation of the device.

We claim:

1. A pressure-sensitive device capable of responding electrically to applied mechanical forces, said device comprising: a body of a flexible, non-conductive material; at least one electrically conductive loop which has opposite ends thereto and is embedded in the said body; a reactance-dependent detecting circuit which is connected to the said loop ends externally of said body and is sensitive to the inductive reactance of the said loop; and a screen of electrically conductive material incorporated in said body and extending alongside the said loop; said body being deformable on application of mechanical forces thereto so as to cause the inductive reactance of the loop to change.

2. A pressure-sensitive device according to claim 1, wherein said body is of elongate form; a single length of wire extends along said elongate body between opposite ends thereof; said screen is in the form of a flexible cover surrounding said body; and said opposite ends of said elongate body are connected together so that the body has the form of a ring and said wire defines said loop.

3. A pressure-sensitive device according to claim 1, wherein said body is of elongate form; a doubled length of wire extends along said body from one end thereof so as to define said loop; and said screen is in the form of a flexible cover surrounding said body.

4. A pressure-sensitive device according to claim 1, wherein the said detecting circuit comprises an oscillator circuit.

5. A pressure-sensitive device according to claim 1 or claim 4, wherein the said screen extends wholly around the said loop.

* * * * *